United States Patent [19]

Brooks

[11] Patent Number: 4,476,933

[45] Date of Patent: Oct. 16, 1984

[54] LUBRICATOR VALVE APPARATUS

[75] Inventor: Robert T. Brooks, Aberdeen, Scotland

[73] Assignee: Baker Oil Tools, Inc., Orange, Calif.

[21] Appl. No.: 484,090

[22] Filed: Apr. 11, 1983

[51] Int. Cl.[3] ..... E21B 34/10

[52] U.S. Cl. ..... 166/324; 166/319

[58] Field of Search ..... 166/319, 321, 323, 324, 166/332, 373, 374, 375, 383, 386, 387, 334; 137/629, 630.19

[56] References Cited

U.S. PATENT DOCUMENTS

| | | | |
|---|---|---|---|
| 3,741,249 | 6/1973 | Leutwyler | 166/324 X |
| 3,826,462 | 7/1974 | Taylor | 166/324 X |
| 3,830,297 | 8/1974 | Cockwell | 166/324 X |
| 3,868,995 | 3/1975 | Crowe | 166/324 |
| 4,103,744 | 8/1978 | Akkerman | 166/32 X |

*Primary Examiner*—Ernest R. Purser
*Assistant Examiner*—Thuy M. Bui
*Attorney, Agent, or Firm*—Norvell & Associates

[57] ABSTRACT

A lubricator valve assembly comprises a reciprocably rotatable ball valve which is operated between open and closed positions solely through the selective application of control pressures and/or tubing pressure above the valve to a double acting sleeve type actuating piston. One end of the actuating piston has a valving piston formed thereon which cooperates with a seal bore in the housing to effect the opening or closing of a bypass fluid passage extending from a region below the ball valve to a region above the ball valve. Such valving piston also functions as part of a lost motion connection between the actuating sleeve piston and a reciprocable actuator for rotating the ball valve. In opening the ball valve, the valving piston first moves upwardly to establish a fluid bypass around the closed ball valve and then establishes contact with the actuator to rotate the ball valve to an open position. The same fluid bypass may be utilized to pump through fluid around the closed ball valve by applying fluid pressure above the ball valve. Improved sealing elements for the ball valve are also provided.

18 Claims, 17 Drawing Figures

LUBRICATOR VALVE APPARATUS

BACKGROUND OF THE INVENTION

1. Field of the Invention

This invention relates to a valve for controlling fluid flow in a well conduit, and particularly to a so-called lubricator valve commonly utilized for installation of tools in an oil or gas well on a wireline while controlling fluids therethrough.

2. Description of the Prior Art

During the completion, testing or workover of a subterranean well at an inland location, it may be necessary to run equipment such as a perforating gun or the like on a wire or electric line into the well when the well is under pressure. This is achieved by inserting the equipment into a length of production tubing above a Christmas tree, the length of tubing being commonly referred to as a "lubricator riser". The lubricator riser section is isolated from the portion of the well therebelow by one or a series of readily accessible valves. On some inland locations, it may be necessary to extend the lubricator section as high as sixty feet into the air.

On floating locations, where space is at a premium and valves are not readily accessible, an inland type lubricator is not practical. For example, use of such an extended length of tubing may be hazardous when applied to an offshore well site utilizing a floating vessel thereabove. Relative motion between the floating vessel and the tubing string, which is anchored within the well within the sea bed, causes considerable difficulty in the manipulation of manual valves.

Most offshore locations will utilize a riser pipe extending from the floating vessel to the ocean floor where it is connected to the uppermost portion of the drilling blowout preventer stack. The riser functions as casing and provides a conduit for mud circulation and isolation of the well from the sea. Whenever the well is "alive" or capable of flowing, there is usually tubing between the floating vessel and the blowout preventer stack. This tubing will lie inside the riser, if a riser is used. This tubing section is available for use as a lubricator section for insertion therethrough of wire or electric line equipment if a valve is provided therebelow. Use of the riser pipe as a lubricator section will eliminate use of a lubricator riser section extending above the floating vessel and will thereby eliminate the hazards involved in such use.

In view of the fact that the lubricator assembly must contain the well pressure while the equipment is inserted therein for subsequent utilization in the well, it is necessary to control the well pressure below the lubricator assembly during this procedure. This is achieved by the use of a valve assembly within the lubricator section. Some prior art lubricator risers contain normally "fail" open valve assemblies which permit the valve to automatically open if hydraulic control pressure is lost. Under certain conditions, if control pressure were lost, a blowout might result. Other lubricator valve assemblies contain normally "fail" closed valve assemblies which permit the valve to automatically close if hydraulic control pressure is lost. Normally "fail" closed valves can close and sever the wire or other line if control pressure is lost. There is, therefore, a possibility of damaging the valve and rendering it inoperable, thereby causing a blowout of the well.

Still other lubricator valve assemblies, such for example as shown in U.S. Pat. No. 4,062,406 to Akkerman et al, provide mechanical means for locking the valve manipulating mechanism when the valve element is in closed position.

It is recognized that any commercially practicable lubricator valve must provide means for reducing metallic friction on the ball valve surfaces during the opering and closing manipulating steps, as well as providing a metal to metal seal when excessive pressures must be resisted by the closed ball valve element.

A further desirable feature for any lubricator valve is the capability of pumping fluid, such as a kill fluid, around the valve when it is in a closed position, thus permitting the well to be brought under control without running the risk of opening the valve to supply the kill fluid.

It is desirable to be able to pressure test the well head when it has been closed and after introduction of a work or production string, prior to re-opening of the lubricator valve. With the present invention, the tubing can be tested between the well head connection and the lubricator with the lubricator valve in the closed position.

A last necessary function of a successful lubricator valve is the requirement that the tubing be pressured from the surface before re-opening the valve. Pressure above the tool must exceed pressure below the tool before it will open, thus assuring control of the well by a pressure source above the lubricator valve.

SUMMARY OF THE INVENTION

The present invention provides a lubricator and valve assembly designed primarily for use in conjunction with the drilling, completion, and workover of subterranean oil and gas wells at offshore locations. The valve assembly preferably contains a reciprocably rotatable ball valve which is operated between open and closed positions through the application of control pressures and/or tubing pressure above the closed valve. A generally tubular actuator is provided for rotating the ball valve between its open and closed positions. A double acting sleeve piston element is provided which is selectively movable in either a valve opening or a valve closing direction through the selective application of control fluid pressure or tubing pressure above the closed valve to opposed piston faces provided on the piston element. A lost motion connection is provided between the ball actuator and the piston element so that the initial movement of the piston element in a valve opening direction produces no movement of the ball valve actuator. Such initial lost motion of the piston element is employed to operate a bypass valving mechanism which is disposed in a fluid passage extending from the main conduit below the valve to a point in the main conduit above the valve. As the piston element moves through its lost motion stroke, a valving element carried by the piston sleeve opens the bypass valve to extablish fluid flow around the closed ball valve, and thus assures the equalization of fluid pressures on the ball valve before the actuator is further shifted by application of a control pressure to initiate the rotational movement of the ball valve to open same.

The sealing of the ball valve in its closed position is accomplished by an annular sealing element which is axially shiftable relative to the ball valve and is urged downwardly into a position of sealing engagement with the ball valve by a spring and/or tubing pressure. A composite spherical segment sealing surface is provided on the annular sealing element comprising an annular band of elastomeric material disposed intermediate to two annular spherical segment metallic surfaces. The elastomeric material normally has a smaller internal diameter than the metallic surfaces and, for relatively light fluid pressures exerted on the ball, the seal is accomplished by the elastomeric sealing element. As the fluid pressure on the ball valve increases, the elastomeric material is compressed and the ground and lapped metal surfaces of the two adjacent metallic sealing bands engage the ball surface and provide an effective seal against high fluid pressures.

Additionally, the external seal provided on the annular sealing element for preventing fluid flow around such element is positioned so that the effective area of the upwardly facing surfaces of the annular sealing element exceeds the effective piston areas of the downwardly facing surfaces of the annular sealing element. Thus, even when the fluid pressure below the ball valve is less than the fluid pressure above the ball valve, such higher fluid pressure above the ball valve exerts a downward bias on the annular sealing element to maintain it in sealing engagement with the ball surface.

The same valving chamber which is utilized to effect the equalization of pressure above and below the close ball valve may be advantageously employed to permit the pump through of a fluid, such as a kill fluid, around the ball in its closed position. In the valve construction embodying the invention, the application of a pressure above the closed valve in excess of the well fluid pressure, accompanied by the neutralization of the pressures acting on the tubular piston element, will result in a limited upward movement of the tubular piston element sufficient to cause the opening of the valving chamber and permit a kill fluid to be pumped around the closed ball valve to control the well in the event of an emergency.

Pressure from above the apparatus can be held by holding control pressure to be applied to the top of the ball valve in the control line and thus holding the valve mechanism shut. This procedure effects an unloading of a piston element, causing excess piston area to push the seat assembly and seals onto the ball element, resulting in complete sealing. It is of no consequence that differential pressure above the ball element is in excess of that below the ball, since control line pressure will cause a balancing of pressures. Additionally, if pressure above the ball valve element is bled off, the "unloader" valve mechanism is held in closed position by tubing pressure from below the valve.

DESCRIPTION OF THE PREFERRED EMBODIMENTS

Figure 1:
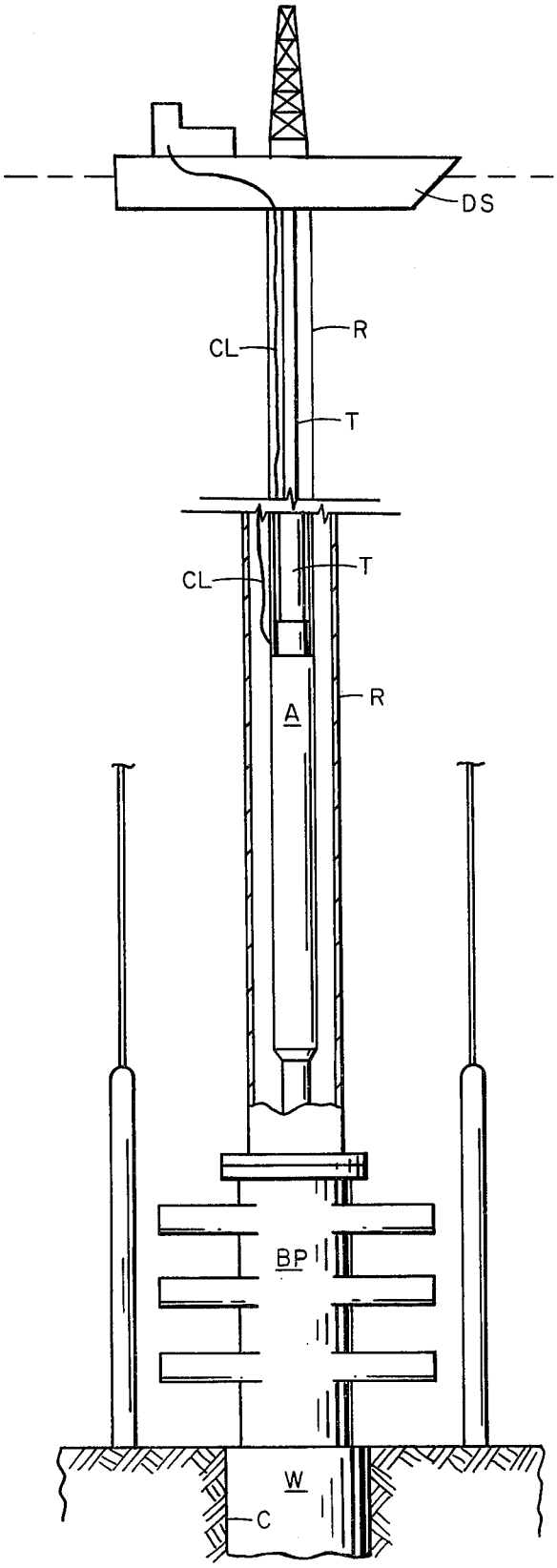
FIG. 1 is a schematic illustration of the valving apparatus of the present invention affixed on a tubing string within a lubricator riser.

Referring to FIG. 1, the apparatus A embodying this invention is carried on tubing T in a riser R extending below a drill ship DS on the ocean. The tubing T extends below the apparatus A and through a blowout preventer stack BP into the well W within the casing C. Control line CL extend from a control panel (not shown) on the drill ship DS to the apparatus A for hydraulic manipulation of the ball valve assembly incorporated in apparatus A.

Figure 2A:
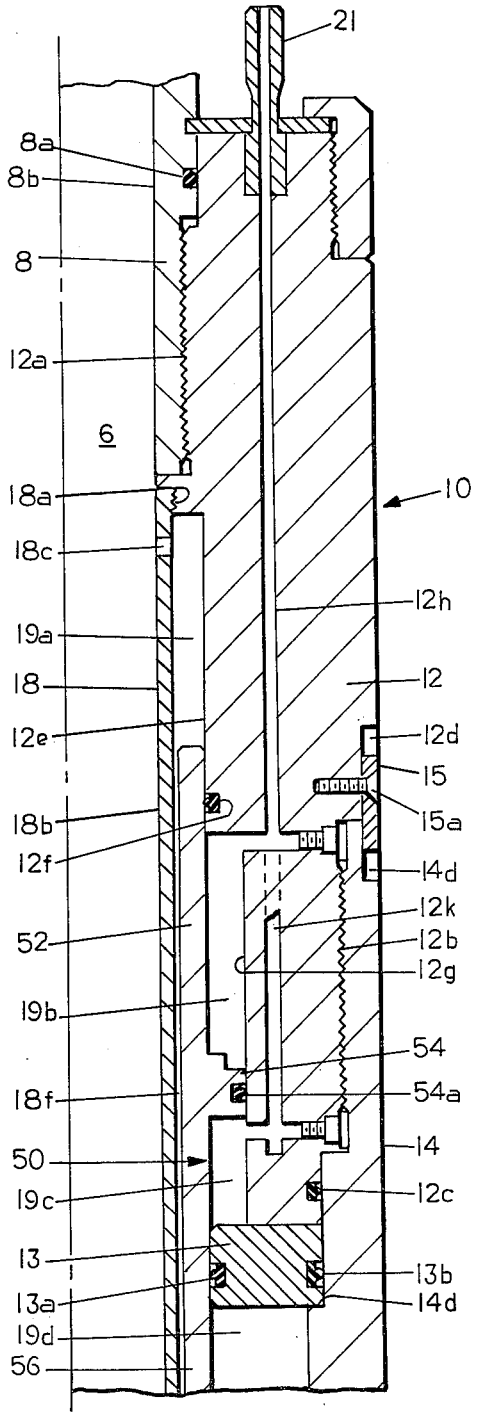
FIGS. 2A, 2B and 2C collectively represent an enlarged scale quarter sectional view of a lubricator valve embodying this invention.
Figure 2B:
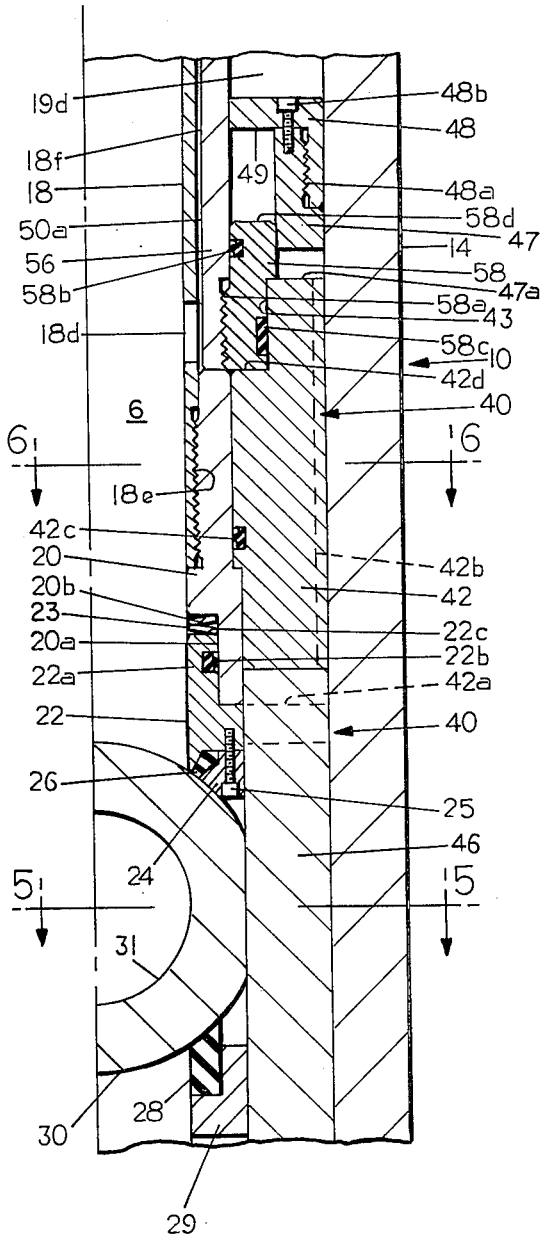
Figure 2C:
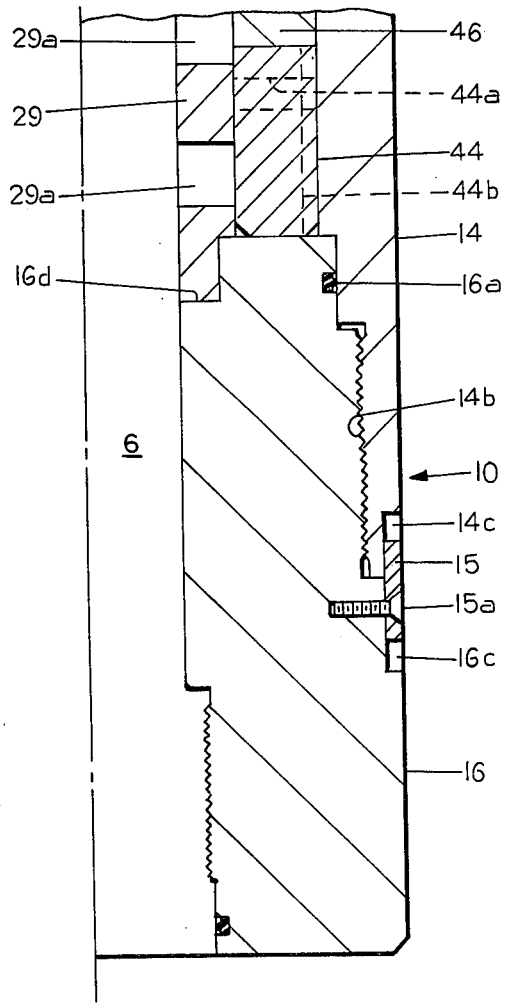

Referring to FIGS. 2A, 2B and 2C, the apparatus A incorporating a lubricator valve embodying this invention comprises an outer housing assembly 10 which is formed by the threaded assembly of an upper housing part 12, an intermediate housing sleeve 14, and a lower housing part 16.

Upper housing part 12 is connected by internal threads **12*a* to the external threads of a coupling 8 forming part of the tubing string T and defining a bore 8*b*. A suitable seal 8*a* effects the sealing of the threaded connection 12*a*. The lower portion of the upper housing part 12 is provided with external threads 12*b* which threadably engage internal threads provided on the upper end of the intermediate housing sleeve 14. A suitable seal 12*c* effects the sealing of the threaded connection 12*b*. A bolt 15*a* traverses a key 15 which is mounted in aligned longitudinal slots 12*d* and 14*d* respectively provided in the adjacent ends of the housing elements 12 and 14 and thus secures the threaded connection 12*b***.

The bottom end of the intermediate housing sleeve 14 is provided with internal threads **14*b* which effect a threaded connection with external threads provided on the bottom housing part 16. A suitable seal 16*a* effects the sealing of the threaded connection 14*b* and a second key 15 is secured by bolt 15*a* in aligned slots 14*c* and 16*c* respectively provided on the adjacent portions of the housing parts 14 and 16 to secure the threaded connection 14*b***.

An inner housing sleeve 18 is secured by external threads **18*a* to an internal surface of the upper housing 12 and thus defines an annular space between the inner sleeve 18 and the outer housing components for the mounting of the valving elements to be hereinafter described. Inner housing sleeve 18 defines an internal bore 18*b* which is substantially the same diameter as the bore 8*b* of the tubing string 8. Additionally, inner housing sleeve 18 is provided with a radial port 18*c* at its upper end and 18*d* at its lower end to permit free fluid flow from the bore of tubing string 8 into the annular chamber defined between the inner housing sleeve 18 and the outer housing assembly 10**.

The lower end of inner housing sleeve 18 terminates above the lower outer housing part 16 and is secured by external threads 18e to an annular sleeve 20. Sleeve 20 defines at its lower end an internal seal bore 20a within which is slidably mounted the upper cylindrical end 22a of a ball seal support 22. A suitable seal 22b engages the seal bore portion 20a of sleeve 20 and a suitable spring, such as a pair of Bellville discs 23, are mounted between a downwardly facing shoulder 20b formed on sleeve 20 and the upwardly facing end 22c of the seal support 22.

Figure 11:
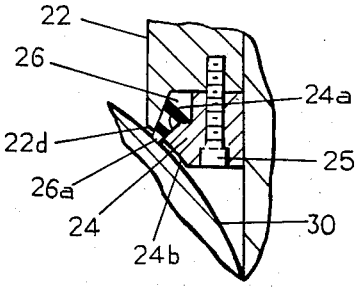
FIG. 11 is an enlarged scale fragmentary view of the improved composite sealing element provided for engagement with the ball surface.

An annular seal retainer 24 is secured to the bottom face of the seal support 22 by a plurality of peripherally spaced bolts 25. The upper face 24a of seal retainer 24 is contoured to provide a holding recess for an elastomeric seal element 26 which has an annular spherical segment sealing face 26a (FIG. 11) disposed between an annular, spherical segment metallic sealing face 24b formed on the seal retainer 24, and an annular spherical segment, metallic sealing surface 22d formed on the bottom end of the seal support 22. The annular, metallic, spherical segment surfaces 22d and 24b are ground and lapped so as to effect a good sealing engagement with the surface of a ball valve 30 which is mounted within housing 12 in a position immediately below the aforementioned sealing surfaces. Preferably, the elastomeric sealing surface 26a is provided with a smaller internal diameter by several thousandths of an inch compared to the diameters of the adjacent metallic sealing surfaces 24b and 22d to permit the elastomeric sealing surface to make the initial sealing contact with the surface of the ball valve 30. Any substantial increase in fluid pressure urging the ball valve 30 toward the sealing surfaces will effect sufficient compression of the elastomeric seal 26 to bring the metallic sealing surfaces 22d and 24b into intimate sealing engagement with the surface of the ball valve 30.

On its lower side, the ball valve 30 is engagable by an annular nylon seat 28 which is mounted in an appropriate recess in a support sleeve 29. Support sleeve 29 is supported on the internal upper surfaces 16d of the lower outer housing part 16. Support sleeve 29 is provided with a plurality of radial ports 29a to permit free fluid flow from the tubing string bore through the support sleeve and into the annular space defined between the support sleeve 29 and the outer intermediate housing sleeve 14. The nylon seat element 28 functions primarily as a stop for limited axial movement of the ball valve 30 away from the aforementioned composite sealing surface defined by metallic surfaces 22d and 24b and the intermediate elastomeric surface 26a. As will be later described, the composite sealing surfaces provide the necessary sealing engagement with the ball 30 in both the open and closed positions of the ball 30, hence the primary function of the lower nylon seat 28 is to provide a stop for any downward movement of the ball valve 30 produced by an excess of fluid pressure above the ball valve 30 over that existing below the ball valve when in the closed position.

Figure 4A:
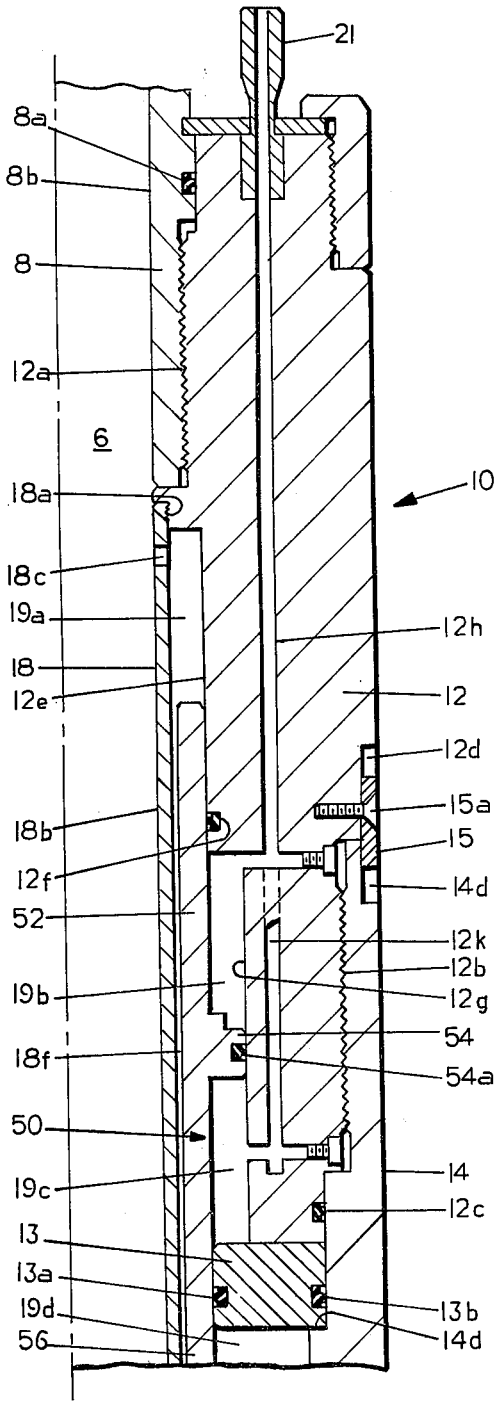
FIGS. 4A, 4B and 4C, respectively, constitute views similar to FIGS. 2A, 2B and 2C, but illustrating the valve in its pumpthrough position.
Figure 4B:
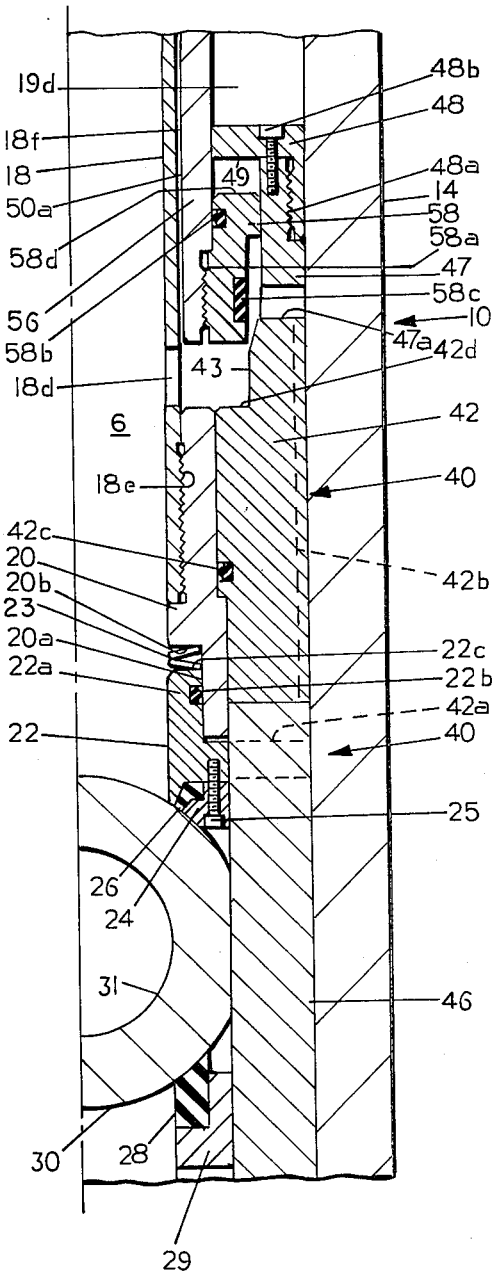
Figure 4C:
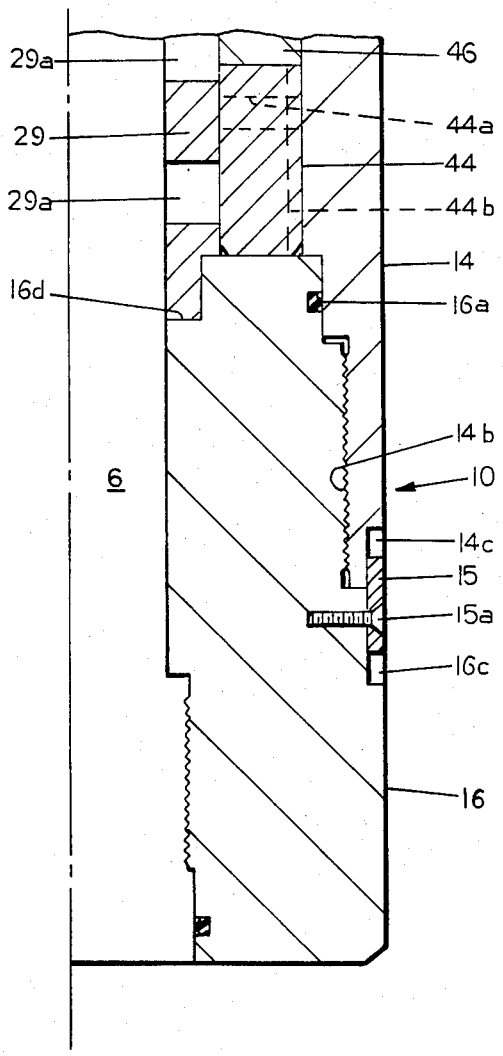
Figure 5:
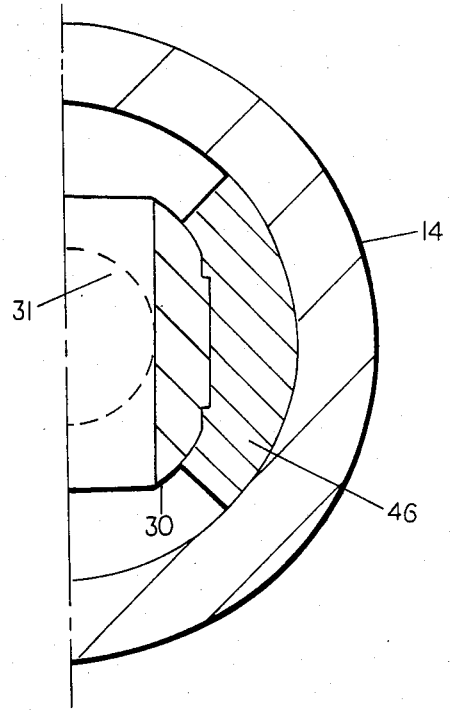
FIG. 5 is a sectional view taken on the plane 5-5 of FIG. 2B.
Figure 6:
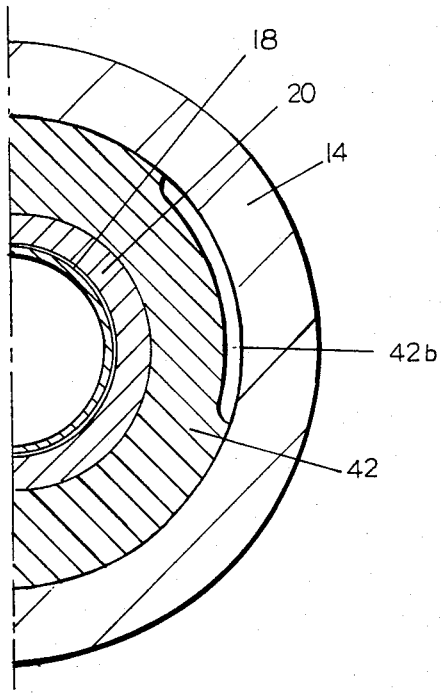
FIG. 6 is a sectional view taken on the plane 6-6 of FIG. 2B.
Figure 7:
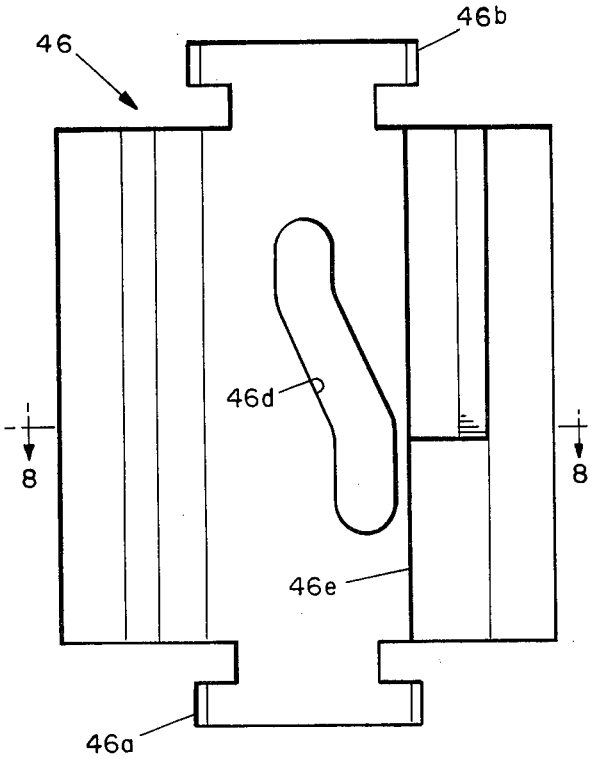
FIG. 7 is an elevational view of a ball engaging actuator segment.

An annular ball valve actuator 40 is provided in surrounding relationship to the ball valve 30 and mounted for limited reciprocal movement within the annular chamber defined within the lower portion of the intermediate outer housing 14. Ball valve actuator 40 comprises upper and lower ring portions 42 and 44 which are interconnected by two diametrically disposed cam slot containing segments 46. The cam slot segments 46 are each provided with "T"-shaped ends 46a and 46b (FIG. 7) which respectively engage correspondingly shaped slots 42a provided in the lower portions of the upper actuator ring portion 42, and slots 44a provided in the upper portion of the lower actuator ring portion 44 (FIG. 4c). Fluid can flow around the exterior of the actuator 40 and, to facilitate such fluid flow, particularly in the case when drilling mud is to be pumped around the closed ball valve 30, the ring portions 42 and 44 are provided with at least one axially extending groove 42b and 44b (FIG. 6) on their respective peripheries. A suitable seal 42c is provided between the internal surface of the upper actuator ring portion 42 and the external surface of the annular sleeve 20. This seal insures that fluid pressures from below the ball valve 30 cannot pass upwardly around the exterior of the seal support 22 and the sleeve 20.

Figure 3A:
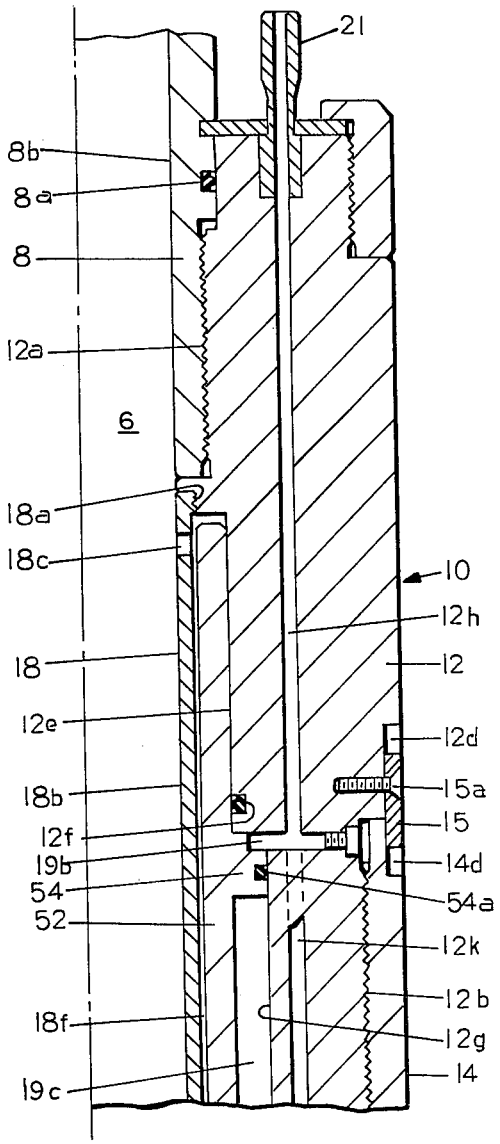
FIGS. 3A, 3B and 3C, respectively, constitute views similar to FIGS. 2A, 2B and 2C, but illustrating the valve in its open position.
Figure 3B:
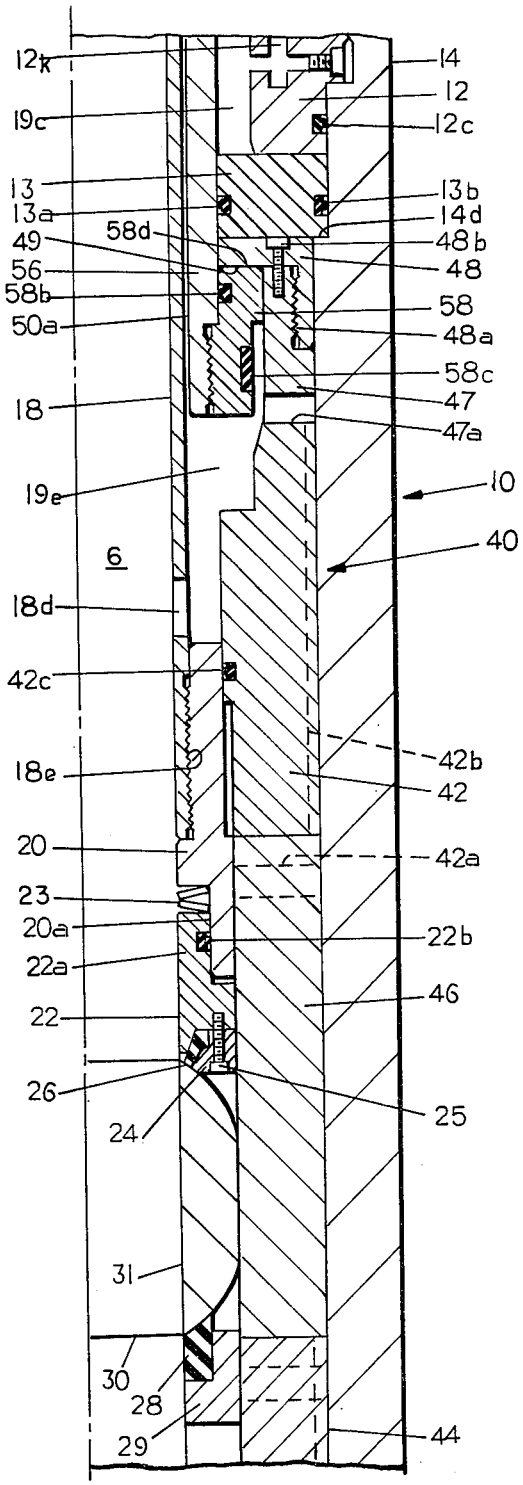
Figure 3C:
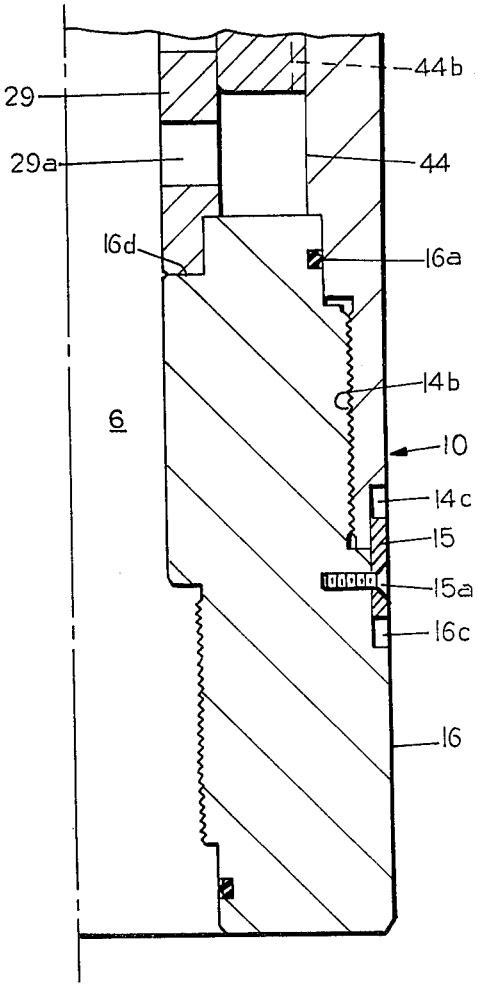

Ball valve 30 is generally of conventional configuration, defining a central aperture 31 which is shifted from an aligned, open position relative to the central bore defined through the apparatus, as shown in FIGS. 3A, 3B and 3C, to a ninety degree displaced closed position wherein the bore 31 is transversely disposed relative to the central bore, as shown in FIGS. 2A, 2B and 2C.

Figure 10:
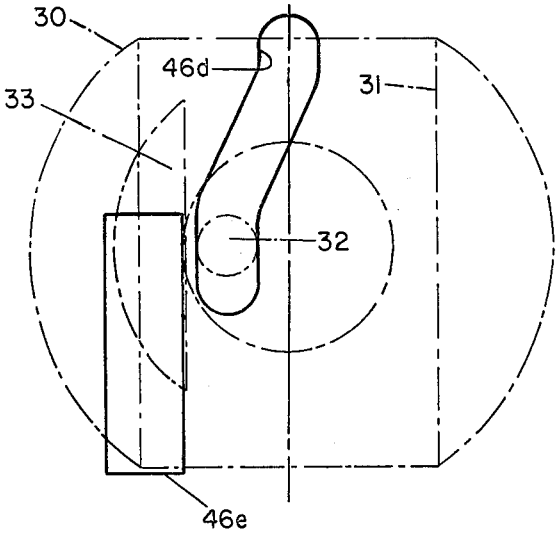
FIG. 10 is a view similar to FIG. 9 but illustrating the ball in its open position.
Figure 8:
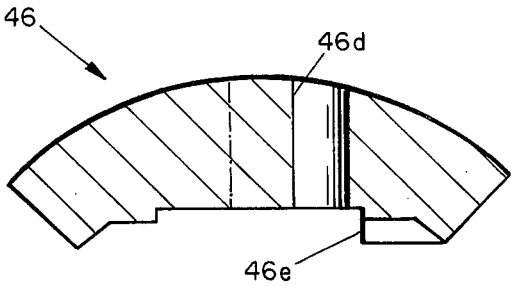
FIG. 8 is a sectional view taken on the plane 8-8 of FIG. 7.
Figure 9:
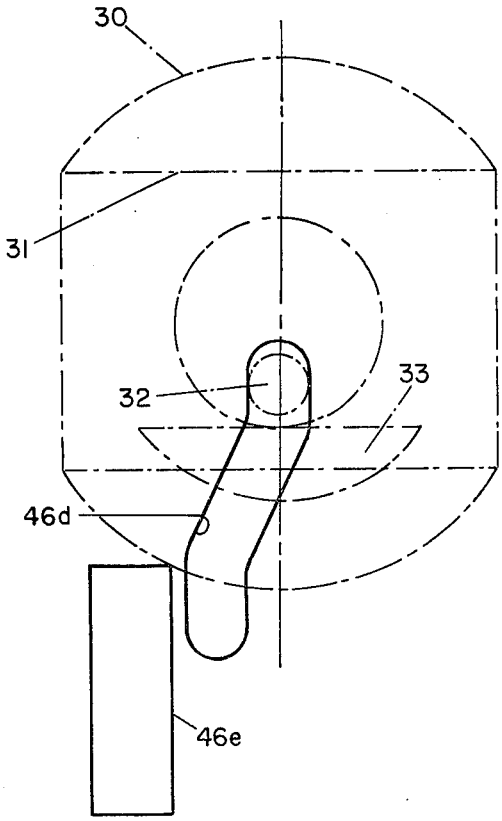
FIG. 9 is a schematic view illustrating the cooperation of a slot in the ball actuator segment with an offset pin on the ball, the ball being shown in its closed position.

The rotary reciprocation of the ball valve 30 by the cam slot containing segment portions 46 of actuator 40 is accomplished in the identical manner that is described in detail in U.S. Pat. No. 4,320,804 to Brooks and is illustrated in the schematic vies of FIGS. 9 and 10 which show the manner in which the cam slots 46d in the actuator segments 46 cooperate with offset projecting pins 32 provided on each side of the ball valve 30. There is, however, one significant modification involved in the rotation of the ball valve 30 to its open position. An internally projecting block 46e is formed on the inner face of one or both of the actuator segments 46 and such block enters into an abutting engagement with a milled slot 33 provided on the face of the ball valve 30 adjacent to the pivot pin 32 as the ball valve 30 rotates to its open position. The cooperation of the milled slot 33 with the block 46e insures that the ball valve will be retained in its fully open position and not be tilted to partially obstruct the fluid flow conduit defined by the apparatus.

The necessary axial reciprocation of the actuator 40 required to effect the rotational movement of the ball valve 30 between its open and closed positions is accomplished in accordance with this invention entirely by the reciprocal movement of an actuating piston sleeve element 50. Piston element 50 is of elongated tubular construction and has an upper end portion 52 that is reciprocable in an annular chamber 19a defined between the upper portions of the inner housing sleeve 18 and an internal wall 12e of the upper outer housing part 12. A seal 12f slidably and sealingly cooperates with the outer surface of piston sleeve portion 52.

An external piston shoulder 54 is medially provided on the actuating piston 50 and provides a mounting for a seal 54a which cooperates with the internal wall 12g of the upper outer housing portion 12 which, in cooperation with the sleeve portion 52 defines a fluid chamber 19b above the piston shoulder 54 and a fluid chamber 19c below the piston shoulder 54. Piston shoulder 54 thus functions as a double acting piston and will be shifted in either direction depending upon whether the higher fluid pressure exists in chamber 19b or 19c.

Conventional vertical conduits 12h and 12k (which are angularly spaced) are respectively provided in the upper outer housing part 12 to permit control fluid pressures to be respectively applied to the fluid chambers 19b and 19c. Such control fluid pressures may comprise either a positive pressure or a connection of the particular chamber to a low pressure or exhaust chamber. Conventional fittings 21 (of which only one is shown) are provided to effect the interconnection of conduits 12h and 12k with control lines CL which lead to the control panel.

A fourth fluid pressure chamber 19d is defined below an annular block 13 which is supported on an upwardly facing shoulder 14d provided on the intermediate outer housing sleeve portion 14. Seal elements 13a and 13b are respectively mounted on the inner and outer peripheral surfaces of the annular block 13 to respectively provide sealing engagement with the inner wall of intermediate housing sleeve 14 and the outer wall of a lower sleeve portion 56 provided on the actuating piston 50. The fourth fluid chamber 19e is always in communication with the fluid pressure existing below the ball valve 30 due to the flow passages 42b and 44b provided around the exterior of the actuator 40 as heretofore described when ball valve 30 is open.

A lost motion connection is provided between the lower end of the actuating piston 50 and the upper portions of the actuator 40. An annular valving piston 58 is threadably secured as by threads 58a to the exterior of the bottom of the lower sleeve portion 56 of actuating piston 50. A seal 58b is provided to seal the threaded connection 58a. The upper end of the upper ring portion 42 of the ball actuator 40 is provided with an axial annular extension 47 to which an L-shaped annular ring 48 is rigidly secured as by threads 48a and lock screws 48b. A portion 49 of ring 48 projects inwardly into the path of movement of the valving piston 58 but, in the lowermost position of the valving piston 58, ring portion 49 is spaced axially above the valving piston 58 to provide for lost motion between the valving piston 58 and the initiation of any movement of the actuator 40.

The lower end of valving piston 58 is provided with an external seal 58c which slidably cooperates with a seal bore 43 provided on the upper ring portion 42 of the actuator 40. It will be noted that the upper side of seal 58c is in fluid communication with the chamber 19d and the fluid passage, including the grooves 42b and 44b, which extend to the main axial conduit of the apparatus below the ball valve 30. The lower side of seal 58c is in fluid communication with the fluid contained in the portion of the main axial conduit above the ball valve 30 by virtue of the radial ports 18c and 18d, and an annular passage 18f defined between the external surface of the inner housing sleeve 18 and the internal bore surface 50a of the actuating piston 50.

The length of seal bore 43 is proportioned so that the seal 58c moves off such seal bore as actuating piston 50 moves upwardly, prior to the top end face 58d of the valving piston 58 contacting the internally projecting abutment portion 49 of ring 48 to initiate upward movement of the ball valve actuator 40. Therefore, it is assured that fluid pressure above and below the closed ball valve 30 is equalized by the upward movement of the valving piston 58 prior to any rotation of the ball valve 30 being effected by the actuator 40. This feature, of course, greatly minimizes the wear on the composite sealing surfaces 22d, 26a, and 24b (FIG. 11) which are in engagement with the exterior surface of ball valve 30, since no fluid pressure differential will be holding the ball valve 30 in contact with the composite sealing surfaces as rotational movement of the ball valve 30 from its closed to its open position occurs. Also no excessive load is applied to pivot pins 32. It should be noted that when the ball valve 30 is in its closed position and well fluid pressure is exerted upwardly against the ball valve, and is the same as, or greater than, that above the ball valve 30, it will remain in its closed position even though the control fluid pressures applied to the fluid chamber 19b may be lost. This is due to the fact that the well fluid pressures will maintain the valving piston 58 in its lowermost position, corresponding to the ball closing position of the actuator 40 because such well fluid pressures maintains a positive downward locking force on the valving piston 58. If pressure is supplied from the well head which exceeds the pressure below the closed ball valve 30, it is necessary to maintain control line pressure in the fluid pressure chamber area 19b. Otherwise the valving piston 58 would be moved upward due to a greater force being applied across the downwardly facing surfaces of the valving piston tending to push it upwardly to effect the opening of the ball valve.

This invention advantageously utilizes the valving piston and the lost motion connection between the valving piston and the ball valve actuator to effect a pumpthrough of a fluid, such as a kill fluid, when such action is required to be accomplished without opening ball valve 30. With the ball valve 30 in its closed position (FIGS. 4A, 4B and 4C), it is readily possible to increase the pressure in the main bore conduit 6 above the ball valve 30 to a level in excess of the pressure existing in the main bore conduit 6 below the ball valve. At the same time, the control pressures operating on the opposite faces of the piston shoulder 54 are equalized so that no motion of the piston shoulder is produced by the control fluid pressures. Under these conditions, the actuating piston 50 will then be moved up until the seal 58c on the valving piston 58 clears the seal bore 43 and re-establishes equalization of fluid pressure around the ball valve by pumping fluid from above the valve through the fluid pressure chamber 19d and the axially extending ports 42b and 44b in the manner heretofore described. To facilitate such fluid pumpthrough, a plurality of radial ports 47a may be provided in the actuator extension 47 to provide a more direct path for the fluid to flow into the axially extending ports 42b.

A further feature of this invention lies in the proportioning of the diametrical relationship of the composite seals engaging the ball valve 30 to that of the seal 22b provided on the exterior of the seal support 22. Such seals are diametrically located so that there is a greater upwardly facing area of the seal support 22 than downwardly facing area intermediate the two sets of seals. For this reason, in the event that a higher fluid pressure exists above a closed ball valve 30 than below such valve, the seal support 22 is urged by the differential area into firm sealing engagement with the periphery of the ball valve 30. Ball valve 30 is held in position by seat 28 and support sleeve 29 being held rigidly by abutment with face 16d on lowermost housing 16.

The operation of the lubricator valve assembly heretofore described will be apparent to those skilled in the art from the foregoing description. Assuming that the ball valve 30 is in the closed position, it may be opened by applying an exhaust or zero control fluid pressure to fluid chambers 19b and 19c. Fluid pressure is then applied from the well head to conduit bore 6, pressurizing chamber 19e below valving piston 58 and producing an upward movement of the actuating piston 50. Such upward movement first moves the seal 58*c* of valving piston 58 off the seal bore 43 and equalizes the fluid pressure on both sides of the closed ball valve 30. After such equalization, control fluid pressure is applied to chamber 19*c* to move the valving piston 58 upwardly into abutting contact with internally projecting abutment portion 49 of ring 48 shifting the actuator segment 46 upwardly, and thus causing rotation of the ball valve 30 to its fully open position (FIGS. 3A, 3B, and 3C). The cooperation of the lug 46*e* on the actuator 40 with the milled slot 33 on the ball valve 30 holds the ball valve 30 exactly in its full open position, thus eliminating any constriction of the flow passage defined by the main conduit bore 6.

To close the ball valve 30, the fluid pressures in the chambers 19*c* and 19*b* are reversed to produce a downward movement of the actuating piston 50. Such downward movement first re-establishes seal 58*c* on valving piston 58 with the seal bore 43 and then moves the bottom face of the valving piston 58 into engagement with the upwardly facing surface 42*d* of the actuator 40 to initiate downward movement of the actuator 40. Such downward movement effects the rotation of the ball valve 30 in the opposite direction to return it to its closed position. The pumpthrough operation (FIGS. 4A, 4B, and 4C) has already been described and will not be repeated.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. An apparatus for installation of drilling, completion, workover tools, or parts thereof for subsequent use in an oil or gas well and for control of fluids through a conduit defined by said apparatus, comprising: valve means for control of fluid transmission through said conduit; a reciprocably shiftable actuator for said valve means, said actuator being shiftable in one direction to open said valve means and in the opposite direction to close said valve means; fluid pressure activatable means mounted for reciprocable movement adjacent said reciprocably shiftable actuator; means defining a lost motion connection between said fluid pressure activatable means and said reciprocably shiftable actuator; a first piston surface on said fluid pressure activatable means movable in a first chamber and responsive to a first applied control pressure to shift said fluid pressure activatable means in a valve opening direction; a second piston surface on said fluid pressure activatable means movable in a second chamber and responsive to a second applied control pressure to shift said fluid pressure activatable means in a valve closing direction; and means responsive to the initial movement of said fluid pressure activatable means in said valve opening direction for opening a fluid passage around said valve means.

2. The apparatus of claim 1 wherein said valve means comprises a ball valve rotatable between open and closed positions relative to said conduit; said actuator comprises a generally cylindrical cage surrounding said ball valve, and said fluid passage comprises an axially extending groove on the periphery of said cage.

3. An apparatus for installation of drilling, completion, workover tools, or parts thereof for subsequent use in an oil or gas well and for control of fluids through a conduit defined by said apparatus, comprising: valve means for control of fluid transmission through said conduit; a reciprocably shiftable actuator for said valve means, said actuator being shiftable in one direction to open said valve means and in the opposite direction to close said valve means; fluid pressure activable means mounted for reciprocable movement adjacent said reciprocably shiftable actuator; means defining a lost motion connection between said fluid pressure activable means and said reciprocably shiftable actuator; a first piston surface on said ffluid pressure activable means movable in a first chamber and responsive to a first applied control pressure to shift said fluid pressure activable means in a valve opening direction; a second piston surface on said fluid pressure activable means movable in a second chamber and responsive to a second applied control pressure to shift said fluid pressure activable means in a valve closing direction; a valve chamber adjacent the path of said fluid pressure activable means; fluid passage means connecting said valve chamber with said conduit above and below said valve means; and a valving head mounted on said fluid pressure activable means and positioned in said valve chamber only in the valve closed position of said fluid pressure activable means to prevent fluid flow around said valving means until said fluid pressure activable means initially moves toward said valve open position.

4. The apparatus of claims 1 or 3 wherein said valve means comprises a ball valve rotatable between open and closed positions relative to said conduit; an annular seal support mounted above said ball valve; a first annular seal carried by said seal support and engageable with said ball; resilient means urging said seal support into sealing engagement with said ball valve; and a second annular seal on said seal support disposed above and radially outward of said annular sealing means to prevent fluid flow around said annular seal, the upwardly facing areas of said seal support intermediate said first and second annular seals exceeding the downwardly facing areas of said seal support intermediate said first and second annular seals, whereby a higher fluid pressure in said cnduit above said ball valve urges said annular seal support against said ball valve.

5. A lubricator assembly for use in conjunction with the drilling, completion, or workover of a subterranean well, said lubricator assembly extendable within a well riser pipe, said assembly connectable to a tubing string extendable through the riser pipe for control of well pressure within said tubing string while drilling, completion, or workover tools and parts thereof are inserted within said tubing string and said lubricator assembly for subsequent insertion into said well; said lubricator assembly comprising: a housing connectable to said tubing string and defining a fluid conduit through said assembly, said conduit communicating with a complimentary fluid passageway within said tubing string; valve means within said assembly for selective control of fluid flow through said assembly within said conduit; a reciprocably shiftable actuator for said valve means, said actuator being shiftable in one direction to open said valve means and in the opposite direction to close said valve means; fluid pressure activable means mounted for reciprocable movement adjacent said reciprocably shiftable actuator; means defining a lost motion connection between said fluid pressure activable means and said reciprocably shiftable actuator; a first piston surface on said fluid pressure activable means movable in a first chamber and responsive to a first applied control pressure to shift said fluid pressure activable means in a valve opening direction; a second piston surface on said fluid pressure activable means movable in a second chamber and responsive to a second applied control pressure to shift said fluid pressure activable means in a valve closing direction; and means responsive to the initial movement of said fluid pressure activable means in said valve opening direction for opening a fluid passage around said valve means.

6. A lubricator assembly for use in conjunction with the drilling, completion, or workover of a subterranean well, said lubricator assembly extendable within a well riser pipe, said assembly connectable to a tubing string extendable through the riser pipe for control of well pressure within said tubing string while drilling, completion, or workover tools and parts thereof are inserted within said tubing string and said lubricator assembly for subsequent insertion into said well; said lubricator assembly comprising: a housing connectable to said tubing string and defining a fluid conduit through said assembly, said conduit communicating with a complimentary fluid passageway within said tubing string; valve means within said assembly for selective control of fluid flow through said assembly within said conduit; a reciprocably shiftable actuator for said valve means, said actuator being shiftable in one direction to open said valve means and in the opposite direction to close said valve means; fluid pressure activable means mounted for reciprocable movement adjacent said reciprocably shiftable actuator; means defining a lost motion connection between said fluid pressure activable means and said reciprocably shiftable actuator; a first piston surface on said fluid pressure activable means movable in a first chamber and responsive to a first applied control pressure to shift said fluid pressure activable means in a valve opening direction; a second piston surface on said fluid pressure activable means movable in a second chamber and responsive to a second applied control pressure to shift said fluid pressure activable means in a valve closing direction; a valve chamber adjacent the path of said fluid pressure activable means; fluid passage means connecting said valve chamber with said conduit above and below said valve means; and a valving head mounted on said fluid pressure activable means and positioned in said valve chamber only in the valve closed position of said fluid pressure activable means to prevent fluid flow around said valving means until said fluid pressure activable means initially moves toward said valve open position.

7. The apparatus of claim 6 wherein said valve means comprises a ball valve rotatable between open and closed positions relative to said conduit; said actuator comprises a generally cylindrical cage surrounding said ball valve, and said fluid passage means includes an axially extending groove on the periphery of said cage.

8. A valve apparatus for incorporation in a tubing string of a well to selectively control fluid flow through said tubing, comprising: a housing connectable in the tubing string and including an inner tubular member defining a fluid conduit and an outer tubular member defining an annular space around said inner tubular member; a first annular ball seat axially slidably mounted on the lower end of said inner tubular member; a second annular ball seat mounted on said housing in axially spaced relationship to said first annular ball seat, an apertured ball valve positioned intermediate said first and second ball seats and reciprocably rotatable between an open and a closed position relative to said conduit; resilient means urging said first annular ball seat into sealing engagement with said ball valve; a generally tubular ball valve actuator disposed in said housing annular space and operatively connected to said ball valve to rotate same between said open and closed positions by reciprocal axial movements of said activator; a piston sleeve reciprocably mounted in said housing annular space adjacent said inner tubular member; an external piston shoulder on said piston sleeve defining opposed first and second piston faces; means in said housing defining cylinder chambers respectively cooperating with said piston faces; conduit means for selectively supplying control fluid pressure to said cylinder chambers to shift said piston sleeve upwardly or downwardly; means defining a lost motion connection between said piston and said ball actuator, whereby said piston sleeve moves initially in a ball valve opening direction without moving said ball actuator; means defining a fluid passage around said ball valve; and valve means operable by said initial movement of said piston sleeve in the ball valve opening direction for opening said fluid passage around said ball valve, thereby equalizing fluid pressure around said ball valve prior to opening same.

9. The apparatus of claim 8 wherein said fluid passage comprises an axially extending external groove in said tubular ball actuator.

10. The apparatus of claim 8 wherein said valve means comprises an open-ended fluid chamber in said actuator, and a second piston shoulder on said piston sleeve is movable out of said open-ended chamber during the initial lost motion movement of said piston sleeve in the ball valve opening direction.

11. The apparatus of claim 10 wherein said lost motion connection means comprises an internally projecting flange on said ball actuator engageable by said piston sleeve after said second piston shoulder moves out of said open-ended chamber.

12. A lubricator assembly for use in conjunction with the drilling, completion, or workover of a subterranean well, said lubricator assembly extendable within a well riser pipe, said assembly connectable to a tubing string extendable through the riser pipe for control of well pressure within said tubing string while drilling, completion, or workover tools and parts thereof are inserted within said tubing string and said lubricator assembly for subsequent insertion into said well; said lubricator assembly comprising: a housing connectable in the tubing string and including an inner tubular member defining a fluid conduit and an outer tubular member defining an annular space around said inner tubular member; a first annular ball seat axially slidably mounted on the lower end of said inner tubular member; a second annular ball seat mounted on said housing in axially spaced relationship to said first annular ball seat, an apertured ball valve positioned intermediate said first and second ball seats and reciprocably rotatable between an open and a closed position relative to said conduit; resilient means urging said first annular ball seat into sealing engagement with said ball valve; a generally tubular ball valve actuator disposed in said housing annular space and operatively connected to said ball valve to rotate same between said open and closed positions by reciprocal axial movements of said actuator; a piston sleeve reciprocably mounted in said housing annular space adjacent said inner tubular member; an external piston shoulder on said piston sleeve defining opposed first and second piston faces; means in said housing defining cylinder chambers respectively cooperating with said piston faces; conduit means for selectively supplying control fluid pressure to said cylinder chambers to shift said piston sleeve upwardly or downwardly; means defining a lost motion connection between said piston and said ball actuator, whereby said piston sleeve moves initially in a ball valve opening direction without moving said ball actuator; means defining a fluid passage around said ball valve; and valve means operable by said initial movement of said piston sleeve in the ball valve opening direction for opening said fluid passage around said ball valve, thereby equalizing fluid pressure around said ball valve prior to opening same.

13. A valve apparatus for incorporation in a tubing string of a well to selectively control fluid flow through said tubing, comprising: a housing connectable in the tubing string and including an inner tubular member defining a fluid conduit and an outer tubular member defining an annular space around said inner tubular member; a first annular ball seat axially slidably mounted on the lower end of said inner tubular member; a second annular ball seat mounted on said housing in axially spaced relationship to said first annular ball seat, an apertured ball valve positioned intermediate said first and second ball seats and reciprocably rotatable between an open and a closed position relative to said conduit; resilient means urging said first annular ball seat into sealing engagement with said ball valve; a generally tubular ball valve actuator disposed in said housing annular space and operatively connected to said ball valve to rotate same between said open and closed positions by reciprocal axial movements of said actuator; fluid pressure activable means mounted in said housing annular space for reciprocable movement adjacent said axially reciprocable actuator; means defining a lost motion connection between said fluid pressure activable means and said reciprocably shiftable actuator; a first piston surface on said fluid pressure activable means movable in a first chamber in said housing and responsive to a first applied control pressure to shift said fluid pressure activable means in a valve opening direction; a second piston surface on said fluid pressure activable means movable in a second chamber in said housing and responsive to a second applied control pressure to shift said fluid pressure activable means in a valve closing direction; and means responsive to the initial movement of said fluid pressure activable means in said valve opening direction for opening a fluid passage around said ball valve.

14. A valve apparatus for incorporation in a tubing string of a well to selectively control fluid flow though said tubing, comprising: a housing connectable in the tubing string and including an inner tubular member defining a fluid conduit and an outer tubular member defining an annular space around said inner tubular member; a first annular ball seat axially slidably mounted on the lower end of said inner tubular member; a second annular ball seat mounted on said housing in axially spaced relationship to said first annular ball seat, an apertured ball valve positioned intermediate said first and second ball seats and reciprocably rotatable between an open and a closed position relative to said conduit; resilient means urging said first annular ball seat into sealing engagement with said ball valve; a generally tubular ball valve actuator disposed in said housing annular space and operatively connected to said ball valve to rotate same between said open and closed positions by reciprocal axial movements of said actuator; fluid pressure activable means mounted in said housing annular space for reciprocable movement adjacent said axially reciprocable actuator; means defining a lost motion connection between said fluid pressure activable means and said reciprocably shiftable actuator; a first piston surface on said fluid pressure activable means movable in a first chamber in said housing and responsive to a first applied control pressure to shift said fluid pressure activable means in a valve opening direction; a second piston surface on said fluid pressure activable means movable in a second chamber in said housing and responsive to a second applied contrl pressure to shift said fluid pressure activable means in a valve closing direction; a valve chamber in said housing adjacent the path of said fluid pressure activable means; fluid passage means connecting said valve chamber with said conduit above and below said ball valve; and a valving head mounted on said fluid pressure activable means and positioned in said valve chamber only in the valve closed position of said fluid pressure activable means to prevent fluid flow around said ball valve until said fluid pressure activable means moves toward said valve open position.

15. A valve apparatus for incorporation in a tubing string of a well to selectively control fluid flow through said tubing, comprising: a housing connectable in the tubing string and including an inner tubular member defining a fluid conduit and an outer tubular member defining an annular space around said inner tubular member; a first annular ball seat axially slidably mounted on the lower end of said inner tubular member; a second annular ball seat mounted on said housing in axially spaced relationship to said first annular ball seat, an apetured ball valve positioned intermediate said first and second ball seats and reciprocably rotatable between an open and a closed position relative to said conduit; resilient means urging said first annular ball seat into sealing engagement with said ball valve; a generally tubular ball valve actuator disposed in said housing annular space and operatively connected to said ball valve to rotate same between said open and closed positions by reciprocal axial movements of said activator; fluid pressure activable means mounted in said housing annular space for reciprocable movement adjacent said reciprocably shiftable actuator; means defining a lost motion connection between said fluid pressure activable means and said axially reciprocable actuator; a first piston element on said fluid pressure activable means movable in a first chamber in said housing and responsive to a first applied control pressure to shift said fluid pressure activable means in a valve opening direction; a second piston element on said fluid pressure activable means movable in a second chamber in said housing and responsive to a second applied control pressure to shift said fluid pressure activable means in a valve closing direction; a third piston element on said fluid pressure activable means movable in an open end third chamber in said housing only during the initial portion of the lost motion movement of said fluid pressure activable means in a valve opening direction; a first fluid passage connecting the inner portion of said third chamber to said conduit above said ball valve; a second fluid passage connecting the outer portion of said third chamber to said conduit below said valve means, whereby said initial lost motion movement of said fluid pressure activable means provides a fluid flow path around said ball valve for pressure equalization or pump through.

16. A valve apparatus for incorporation in a tubing string of a well to selectively control fluid flow through said tubing, comprising: a housing connectable in the tubing string and including an inner tubular member defining a fluid conduit and an outer tubular member defining an annular space around said inner tubular member; a first annular ball seat axially slidably mounted on the lower end of said inner tubular member; a second annular ball seat mounted on said housing in axially spaced relationship to said first annular ball seat, an apertured ball valve positioned intermediate said first and second ball seats and reciprocably rotatable between an open and a closed position relative to said conduit; resilient means urging said first annular ball seat into sealing engagement with said ball valve; a generally tubular ball valve actuator disposed in said housing annular space and operatively connected to said ball valve to rotate same between said open and closed positions by reciprocal axial movements of said actuator; fluid pressure activable means mounted in said housing annular space for reciprocable movement adjacent said axially reciprocable actuator; means defining a lost motion connection between said fluid pressure activable means and said reciprocably shiftable actuator; a double acting piston element on said fluid pressure activable means responsive to the selective application of an applied control fluid pressure to opposite sides of said double acting piston element to selectively shift said fluid pressure activable means in either a valve opening or a valve closing direction; a second piston element on said fluid pressure activable means responsive to fluid pressure in said conduit above said valve means to urge said fluid pressure activable means only in a valve opening direction; a cylinder chamber connected to said conduit above said valve means, said cylinder chamber being slidably and sealingly cooperable with said second piston element only during a portion of said lost motion movement of said fluid pressure activable means; and fluid passage means connecting said cylinder chamber with said conduit below said valve means when said second piston element moves out of said cylinder chamber, thereby equalizing fluid pressure above and below said valve means prior to effecting opening movement of said valve means.

17. The apparatus of claim 16 wherein said first annular ball seat comprises a composite spherical segment ball sealing surface including an annular band of elastomeric material disposed between two annular metallic sealing surfaces said annular metallic sealing surfaces being ground to spherical segment configuration and said elastomeric sealing surface has a diameter less than said metallic sealing surfaces, whereby low pressure differentials across said ball are sealed by said elastomeric sealing surface and high pressure differentials across said ball are additionally sealed by said metallic sealing surfaces.

18. The apparatus of claim 16 wherein said first annular ball seat has a first annular seal surface engaging said ball valve and a second external annular seal engaging said housing to prevent fluid flow around said first annular ball seat, the upwardly facing areas of said first annular ball seat intermediate said first and second annular seal surfaces exceeding the downwardly facing areas of said first annular ball seat intermediate said first and second annular sealing surfaces, whereby a higher fluid pressure in said conduit above said ball valve urges said first annular ball seat against said ball valve.

* * * * *